US007542014B2

(12) United States Patent
Kim

(10) Patent No.: US 7,542,014 B2
(45) Date of Patent: Jun. 2, 2009

(54) PLASMA DISPLAY DEVICE AND DRIVING METHOD THEREOF

(75) Inventor: Myoung-Kwan Kim, Suwon-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 607 days.

(21) Appl. No.: 11/208,161

(22) Filed: Aug. 18, 2005

(65) Prior Publication Data

US 2006/0158387 A1 Jul. 20, 2006

(30) Foreign Application Priority Data

Jan. 17, 2005 (KR) ..... 10-2005-0004112

(51) Int. Cl.
*G09G 3/28* (2006.01)

(52) U.S. Cl. ..... 345/60; 345/62; 345/68

(58) Field of Classification Search ..... 345/600, 345/60, 68, 62
See application file for complete search history.

(56) References Cited

U.S. PATENT DOCUMENTS

| | | | | |
|---|---|---|---|---|
| 4,866,349 | A | 9/1989 | Weber et al. | |
| 5,081,400 | A | 1/1992 | Weber et al. | |
| 6,580,406 | B2 * | 6/2003 | Watanabe | 345/63 |
| 2005/0116887 | A1 * | 6/2005 | Lee et al. | 345/60 |
| 2005/0134532 | A1 * | 6/2005 | Choi et al. | 345/60 |
| 2006/0050067 | A1 * | 3/2006 | Kwak et al. | 345/211 |

FOREIGN PATENT DOCUMENTS

| | | |
|---|---|---|
| JP | 07-169403 | 7/1995 |
| JP | 09-006283 | 1/1997 |
| JP | 11-282416 | 10/1999 |
| JP | 11-316572 | 11/1999 |
| JP | 2001-306029 | 11/2002 |
| JP | 2003-015590 | 1/2003 |
| JP | 2003-015593 | 1/2003 |
| JP | 2003-122296 | 4/2003 |
| JP | 2004-061702 | 2/2004 |
| JP | 2004-177815 | 6/2004 |
| JP | 2004-226792 | 8/2004 |
| KR | 10-2004-0027058 | 4/2004 |
| WO | WO 2006/013658 | 2/2006 |

* cited by examiner

*Primary Examiner*—Amare Mengistu
*Assistant Examiner*—Koosha Sharifi
(74) *Attorney, Agent, or Firm*—Christie, Parker & Hale, LLP

(57) ABSTRACT

A plasma display device determining whether to perform power recovery in address and sustain periods of each subfield according to the temperature of a plasma display panel. When the temperature is outside of a predetermined temperature range, the address voltage is applied by hard switching to the third electrode in order to select the discharge cell to be displayed among the discharge cells in the address period. The sustain discharge pulse voltage is applied by the hard switching to the first and second electrodes in a first group of the sustain period, the sustain period being divided into at least two groups. The sustain discharge pulse voltage is applied by inductor-capacitor resonance of a power recovery circuit to the first and second electrodes in a second group of the sustain period.

8 Claims, 9 Drawing Sheets

PLASMA DISPLAY DEVICE AND DRIVING METHOD THEREOF

CROSS-REFERENCE TO RELATED APPLICATION

This application claims priority to and the benefit of Korean Patent Application No. 10-2005-0004112 filed in the Korean Intellectual Property Office on Jan. 17, 2005, the entire content of which is incorporated herein by reference.

BACKGROUND OF THE INVENTION (a) Field of the Invention

The present invention relates to a plasma display device including a plasma display panel (PDP), and a driving method thereof.

(b) Description of the Related Art

A PDP is a flat panel display that uses plasma generated by gas discharge to display characters or images. It includes, depending on its size, more than several scores to millions of pixels arranged in a matrix pattern.

Generally, in a driving method of a plasma display device, one frame is divided into a plurality of subfields, and the subfields are controlled by time division to thus represent gray scales. Each subfield includes a reset period, an address period, and a sustain discharge period. The reset period is for initializing the status of each discharge cell so as to facilitate an addressing operation on the discharge cell. The address period is for selecting turn-on/turn-off cells, which are the cells that must be turned on or turned off to display the intended image, and for accumulating wall charges on the turn-on cells that are addressed to be turned on. The sustain period is for causing the cells to either continue discharge to display an image on the addressed cells, or to remain inactive.

When respective operations (reset, address, sustain operations) are performed in the respective periods, capacitance exists on the panel since a discharge space between a scan electrode and a sustain electrode, and a discharge space between a surface on which an address electrode is formed and a surface on which scan and sustain electrodes are formed, operate as capacitive loads (hereinafter, referred to as "panel capacitors"). Hence, reactive power for generating a predetermined voltage in view of the capacitance is needed in addition to power for applying waveforms for addressing. Hence, an address driving integrated circuit includes a power recovery circuit for recovering the reactive power and re-using the same, as disclosed from the power recovery circuit by L. F. Weber in U.S. Pat. Nos. 4,866,349 and 5,081,400.

However, when the power recovery circuit is used to apply an address voltage Va to the address electrode in the address period, a time for a voltage of the panel capacitor to reach the voltage Va is delayed and a time for maintaining the voltage Va is shorter as compared to a case when directly applying the address voltage Va to the address electrode. Therefore, not only is an address discharge delayed, but also a light waveform is reduced.

In FIG. 1A and FIG. 1B, the amplitude of respective light waveforms La1 and La2 in respective cases is shown when the power recovery circuit is used to apply the address voltage Va to the address electrode and when address voltage Va is directly applied to the address electrode in the address period. As can be seen in FIG. 1A, when the power recovery circuit is used the address discharge is delayed to time t1 and the light waveform is also reduced to La1.

Accordingly, using the power recovery circuit problematically causes a high probability of address discharge error in the address period.

In addition, wall charge distribution, previous to the address period, formed by applying the driving waveform of the plasma display device, varies according to the temperature of the PDP. More specifically, when the temperature of the PDP is higher or lower than a reference temperature range, the probability for misfiring in the address period becomes very high since wall charges in a plasma state are unstable.

SUMMARY OF THE INVENTION

In accordance with the present invention a plasma display device is provided having the advantages of preventing misfiring in address and sustain periods when the temperature of a plasma display panel is outside of a predetermined temperature range.

The present invention also provides driving method of a plasma display device including a power recovery circuit for applying an address voltage to a third electrode by using resonance between an inductor electrically coupled to the third electrode and a capacitive load (capacitor) formed by first and second electrodes and the third electrodes arranged in a direction crossing the first and second electrodes.

According to an exemplary driving method, the temperature of the PDP is sensed. Whether to perform an address power recovery is determined with reference to the sensed temperature. A reset waveform is applied to the first electrode. After applying the reset waveform to the first electrode an address voltage is applied to the third electrode after generating the address voltage with reference to a determined result as to whether to perform the address power recovery.

The present invention also provides a driving method of a plasma display device including a power recovery circuit for applying a sustain pulse voltage to first and second electrodes by using resonance between an inductor electrically coupled to a third electrode and a capacitive load (capacitor) formed by the first and second electrodes and the third electrodes arranged in a direction crossing the first and second electrodes.

According to an exemplary driving method, the temperature of the PDP is sensed, whether to perform an address power recovery is determined with reference to the sensed temperature, a reset waveform is applied to the first electrode, and an sustain voltage is applied to the third electrode after generating the sustain voltage with reference to a determined result of whether to perform the address power recovery after applying the reset waveform to the first electrode.

An exemplary plasma display device is provided including a power recovery circuit for applying an address voltage to a third electrode and a sustain pulse voltage to first and second electrodes by using resonance between an inductor electrically coupled to the third electrode and a capacitive load (capacitor) formed by the first and second electrodes and the third electrodes arranged in a direction crossing the first and second electrodes includes a plasma display panel (PDP), a panel temperature sensor, and a driving circuit. The plasma display panel (PDP) includes the first and second electrodes, and the third electrode formed in a direction crossing the first and second electrodes, and a discharge cell formed in a crossing part of the first, second, and third electrodes. The panel temperature sensor senses the temperature of the PDP. The driving circuit operates by a plurality of subfields divided from a frame, each subfield including sustain, reset, and address periods.

The driving circuit sets discharge cells so as to perform an address operation after initializing all the discharge cells by applying a reset waveform to the first electrode, applies an address voltage to the third electrode in order to select a discharge cell to be displayed among the discharge cells, alternately applies a sustain discharge pulse voltage to the first and second electrodes in order to generate a sustain discharge in the selected discharge cell, and determines whether to perform a power recovery operation in the address and sustain periods according to the temperature of the PDP.

DETAILED DESCRIPTION

Figure 1A:
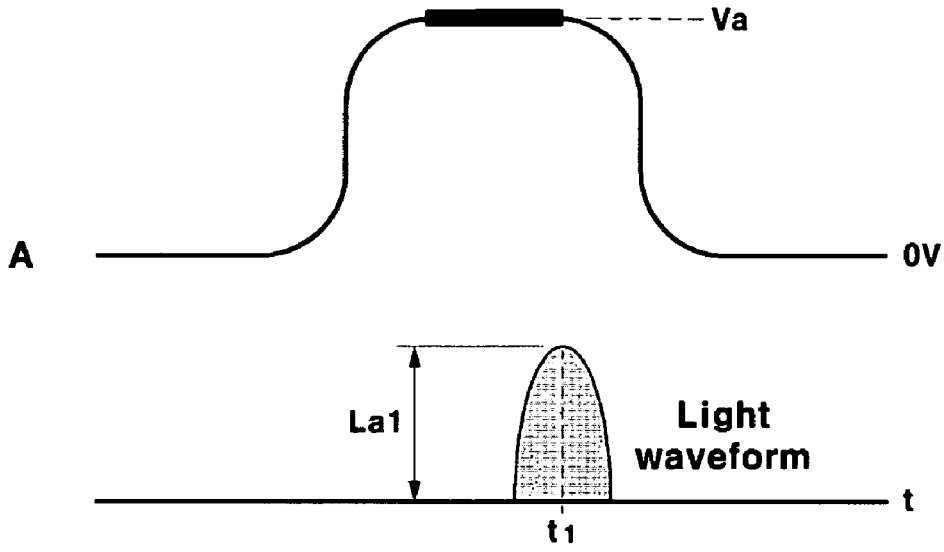
FIG. 1A and FIG. 1B show diagrams representing waveforms applied to an address electrode in an address period.
Figure 1B:
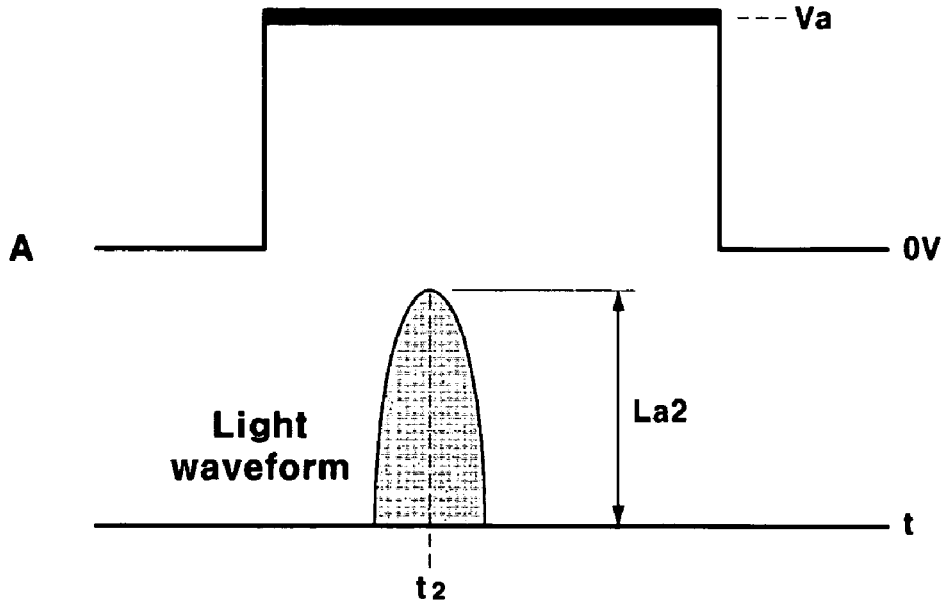
Figure 2:
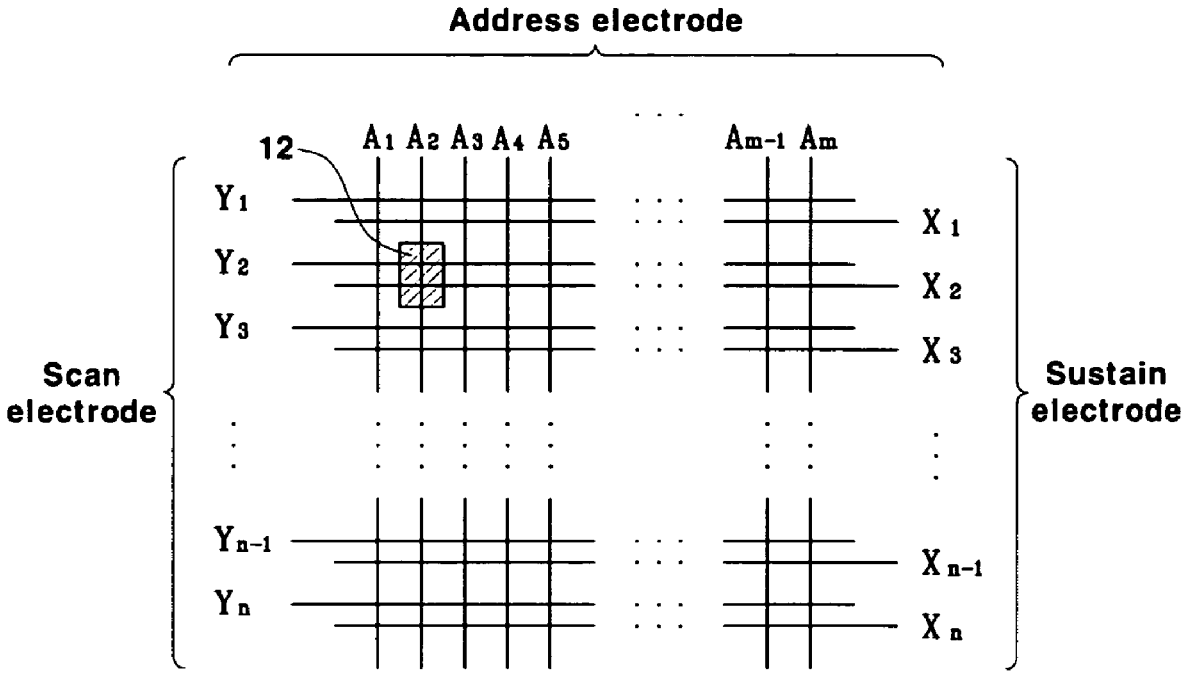
FIG. 2 shows a schematic electrode arrangement diagram of a plasma display panel according to an exemplary embodiment of the present invention.

Referring to FIG. 2, a PDP has an m×n matrix configuration, wherein address electrodes A1 to Am are arranged in rows, and n scan electrodes Y1 to Yn and n sustain electrodes X1 to Xn are alternately arranged in columns.

Figure 3:
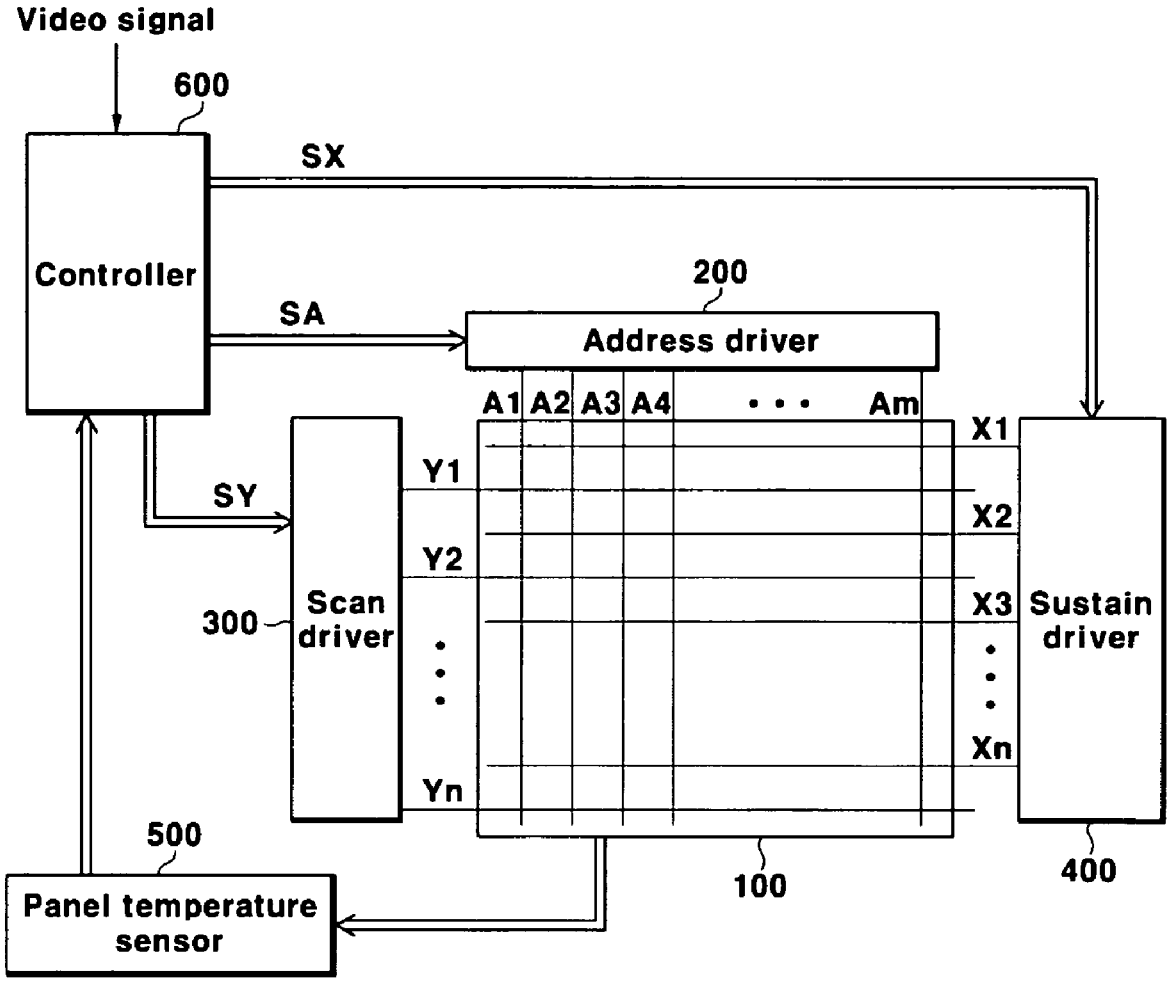
FIG. 3 shows a schematic diagram of a plasma display device according to an exemplary embodiment of the present invention.

Referring now to FIG. 3, the plasma display device according to the exemplary embodiment of the present invention includes a PDP 100, an address driver 200, a scan driver 300, a sustain driver 400, a panel temperature sensor 500, and a controller 600.

The PDP 100 includes a plurality of address electrodes A1 to Am arranged in rows, and scan electrodes Y1 to Yn and sustain electrodes X1 to Xn arranged in columns.

The address driver 200 receives an address driving control signal SA from the controller 200, and applies a voltage for selecting turn-on discharge cells (i.e., discharge cells to be turned on) to the address electrodes A1-Am.

The scan electrode driver 300 and sustain electrode driver 400 respectively receive a scan electrode driving signal SY and a sustain electrode driving signal SX from the controller 600, and apply them to the scan electrodes Y1-Yn and the sustain electrodes X1-Xn.

The controller 600, externally receives video signals, generates the address driving control signal SA, the scan electrode driving signal SY, and the sustain electrode driving signal SX, and respectively applies them to the address driver 200, the scan electrode driver 300, and the sustain electrode driver 400.

The panel temperature sensor 500 senses the temperature of the PDP 100 and transmits information on the sensed temperature to the controller 600. A panel temperature sensor may be installed not only in the PDP 100 to directly sense the temperature of the PDP 100 but also on a rear substrate of the PDP so as to indirectly sense the temperature. Methods for sensing the temperature of the PDP 100 are well known to those skilled in the art.

In addition, a period for performing an operation for sensing the temperature in the panel temperature sensor 500 may be varied within a range that achieves the purpose of the present invention. For example, in one frame, the operation for sensing the temperature may be performed for every subfield, or performed for a predetermined number of subfields.

The controller 600 determines whether to generate an address voltage Va, corresponding to the temperature of the panel transmitted from the panel temperature sensor 500, to be applied to the address electrode A by using the address power recovery circuit, and outputs a driving signal for applying the address voltage to the address driver 200. In addition, the controller 600 determines whether to generate a sustain discharge pulse voltage, corresponding to the temperature of the panel transmitted from the panel temperature sensor 500, to be applied to the scan electrode Y and the sustain electrode X, and outputs a driving signal for applying the sustain discharge pulse to the scan and sustain drivers 300 and 400 after generating the driving signal.

An address driving circuit in the address driver 200 according to the exemplary embodiment of the present invention will now be described with reference to the figures.

Figure 4:
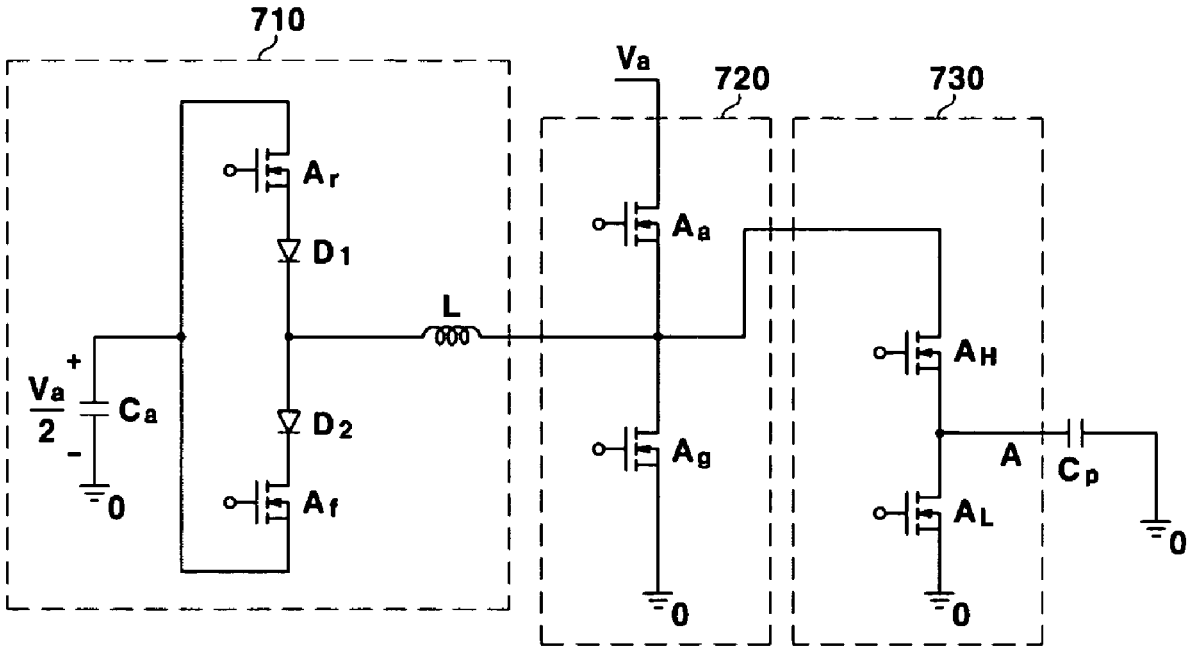
FIG. 4 shows a diagram representing an address driving circuit according to the exemplary embodiment of the present invention.

Referring now to FIG. 4, which shows a diagram of an address driving circuit according to the exemplary embodiment of the present invention. N-channel transistors are used as switches. A field effect transistor (FET) having a body diode or another switch for performing a similar function may be used for the switches.

For convenience of description, capacitance formed by the address A and scan Y electrodes or the address A and sustain X electrodes is illustrated as a panel capacitor Cp.

As shown in FIG. 4, a driving circuit of the address driver 200 according to the exemplary embodiment of the present invention includes a power recovery circuit 710, an address voltage supplier 720, and an address selection circuit 730.

The power recovery circuit 710 includes a capacitor Ca, switches Ar and Af, diodes D1 and D2, and an inductor L. A voltage Va/2 is charged at the capacitor Ca. The capacitor Ca for power recovery is electrically coupled between a drain of the switch Ar and a source of the switch Af, and the diodes D1 and D2 are respectively coupled to the switches Ar and Af in series. A terminal of the inductor L is electrically coupled between a node between the diodes D1 and D2 and a node between the switches Aa and Ag of the address voltage supplier 720. The panel capacitor Cp is coupled to another terminal of the inductor L in series.

The diode D1 is for setting a path for increasing a voltage at the panel capacitor when the switch Ar has a body diode. The diode D2 is for setting a path for decreasing the voltage at the panel capacitor Cp when the switch Af has a body diode.

The diodes D1 and D2 may be eliminated when the switches Ar and Af do not have a body diode. The power recovery circuit of the above configuration is for charging the voltage at the panel capacitor Cp (i.e., a voltage at the address electrode) to a voltage Va, or for discharging the voltage at the panel capacitor Cp to 0V.

When the power recovery circuit is formed, the arrangement of the inductor L, the diode D1, and the switch Ar may vary, and the arrangement of the inductor L, the diode D1, and the switch Af may also vary.

The address voltage supplier 720 is coupled between the address power recovery circuit 710 and a plurality of address selection circuits (one address selection circuit 730 being shown in FIG. 4), and includes the two switches Aa and Ag. The switch Aa is coupled between a power source for supplying the address voltage Va and the switch $A_H$ of the address selection circuit 730. The switch Ag is coupled between a power source for supplying a ground voltage and the switch $A_H$ of the address selection circuit. The switches Aa and Ag respectively supply the voltage Va and 0V to the panel capacitor Cp.

The address selection circuit 730 is coupled to the respective address electrodes A, and includes two switches $A_H$ and $A_L$. The switch $A_H$ is coupled between the power recovery circuit and the address electrode A, the switch $A_L$ is coupled between the address electrode A and ground voltage, and turn-on or turn-off of the switches $A_H$ and $A_L$ may determine whether the address electrode A is selected or not.

An operation of the driving circuit of the address driver 200 according to the exemplary embodiment of the present invention will described, whereby the address driving circuit operates to supply the address voltage in the address period by following four operational modes.

After the reset period is finished, the capacitor Ca for power recovery is charged with a voltage Va/2 which is a half of an external voltage so as to prevent inrush current when an address discharge is started. In this state, an operational mode 1 begins when the switch Ar and the driving switch $A_H$ of the address selection circuit are turned on.

In operational mode 1, an inductor-capacitor (LC) resonance circuit is formed by a path through the capacitor Ca for power recovery, the switch Ar, the diode D1, the inductor L, driving switch AH, and the panel capacitor Cp, and therefore a current flows to the inductor L and an output voltage at the panel is increased.

In operational mode 2, since the switch Aa is turned on and the switch Ar is turned off, the externally applied voltage Va flows directly to the panel capacitor Cp through the switch Aa. Therefore, an output voltage of the panel remains at the voltage Va.

In operational mode 3 for turning on the switch Af and turning off the switch Aa, since an LC resonance circuit is formed by a path through the panel capacitor Cp, the driving circuit AH, the inductor L, the diode D2, the switch Af, and the capacitor Ca for power recovery, the current flows to the inductor L and the output voltage of the panel is decreased.

Then, in operational mode 4, the output voltage of the panel is maintained at 0V since the switch Ag is turned on and the switch Af is turned off. When the switch Ar is turned on inn the operation mode 4, the operation mode 1 begins and the above operation is repeated.

Driving waveforms of the plasma display device according to the exemplary embodiment of the present invention will now be described with reference to the figures.

The wall charges exist in a plasma state, and motion of the wall charges becomes active or weak depending on the temperature of the PDP. For example, since the motion of the wall charges is normal when the temperature of the PDP 100 is within a predetermined temperature range, an appropriate amount of wall charges for the address discharge are accumulated in the address period after the reset period is finished. However, since the motion of the wall charges is not active when the temperature of the PDP 100 is outside of the predetermined temperature range, the wall charges are not appropriately accumulated to each electrode. Accordingly, discharge quality gets deteriorated, and more specifically, when the wall charges are not appropriately accumulated to each electrode after the reset period for initializing all the discharge cells and setting up the wall charges in order to perform a stable address discharge in the address period is finished, a misfiring may occur in a subsequent address period due to the deteriorated discharge quality.

A first exemplary embodiment of the present invention for solving the above problem will now be described with reference to the figures.

Figure 5A:
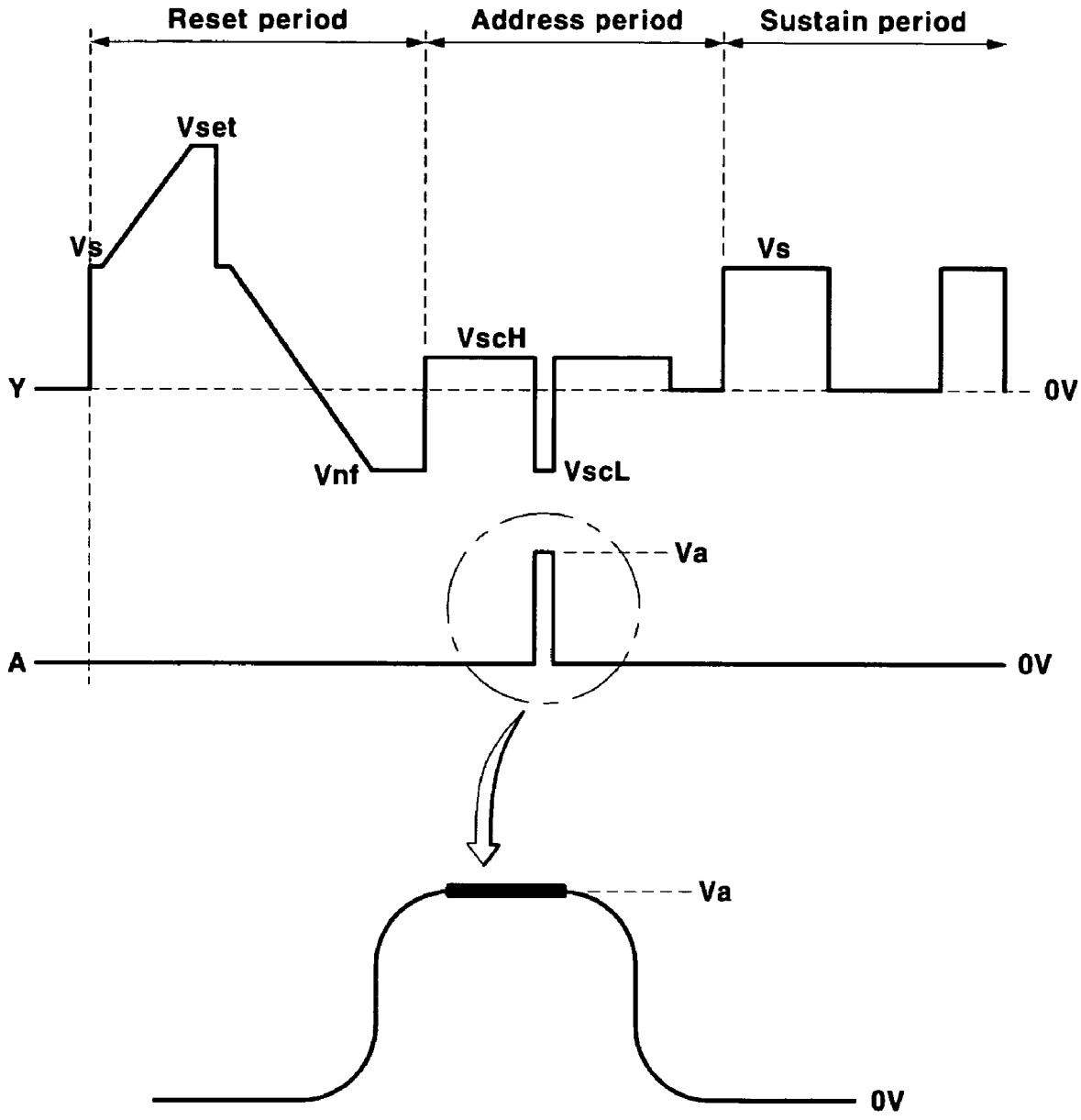
FIG. 5A and FIG. 5B show diagrams representing driving waveforms of a plasma display device according to a first exemplary embodiment of the present invention.
Figure 5B:
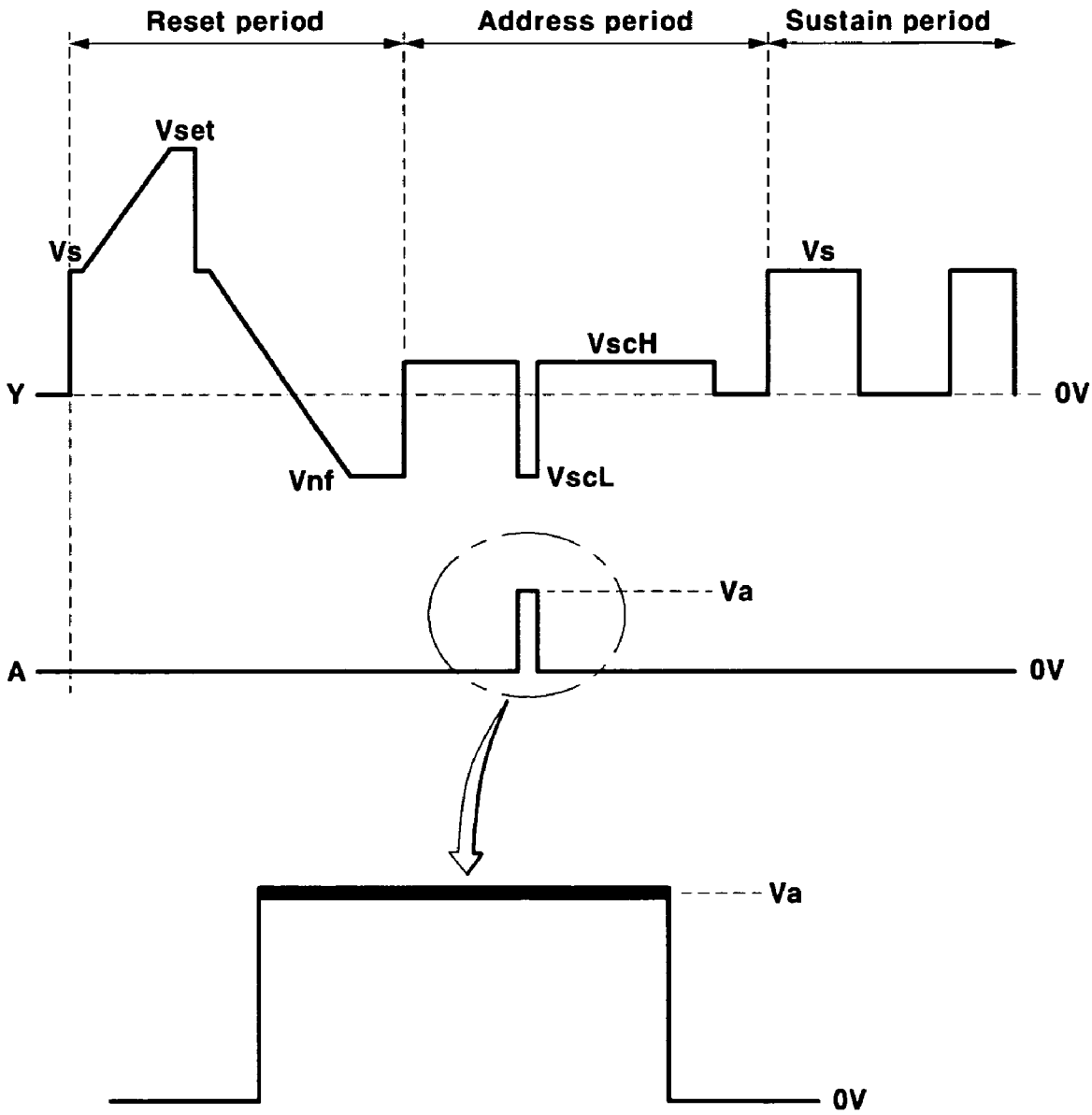

FIG. 5A and FIG. 5B show diagrams representing driving waveforms of the plasma display device according to the first exemplary embodiment of the present invention. FIG. 5A shows a diagram representing the driving waveforms when the temperature of the PDP 100 is within the predetermined temperature range.

As shown FIG. 5A, in a driving method of the plasma display device according to the exemplary embodiment of the present invention, each subfield includes a reset period, an address period, and a sustain period.

The reset period is for initializing the status of each discharge cell so as to facilitate an addressing operation on the discharge cell, and the address period is for selecting turn-on/turn-off cells, which are the cells that must be turned on or turned off to display the intended image, and for accumulating wall charges on the turn-on cells that are addressed to be turned on. The sustain period is for causing the cells to either continue to discharge to display an image on the addressed cells, or to remain inactive.

In the reset period, since all the discharge cells are discharged by a rising ramp voltage, a great amount of negative wall charges is accumulated on the scan electrode Y, and a great amount of positive wall charges is accumulated on the address electrode A.

That is, all the discharge cells are discharged by applying a gradually increasing voltage to the scan electrode in a rising period of the reset period, and the wall charges are erased by applying a voltage gradually decreasing to a negative voltage of Vnf while the sustain electrode X is biased at a predetermined voltage in a falling period of the reset period, and therefore the wall charge state is initialized appropriate for the addressing operation in the subsequent address period. That is, the negative wall charges and the positive wall charges are respectively and sufficiently accumulated on the scan electrode Y and the address electrode A.

The address period is for selecting turn-on/turn-off cells, which are the cells that must be turned on or turned off to display the intended image, and for accumulating wall charges on the turn-on cells that are addressed to be turned on. In the address period, when the scan electrodes are sequentially scanned (when a voltage VscL lower than a bias voltage VscH is applied to the scan electrodes Y), a positive address voltage Va is applied to the address electrode A in order to select the turn-on cells. Then, the wall charges are formed between the scan electrode Y and the sustain electrode X since the address discharge is generated by a wall voltage caused by the wall charges and a difference between the address voltage Va and the voltage VscL (here, the wall charges indicate wall charges formed between the address A and scan Y electrodes, and the difference indicates a difference between the address voltage Va applied to the address electrode A and the voltage VscL applied to the scan electrode).

When the temperature of the PDP 100 is within the predetermined temperature range, the address voltage Va is applied to the address electrode by inductor-capacitor (LC) resonance of the power recovery circuit. Then, the address discharge is stably generated by the negative wall charges and the positive wall charges respectively accumulated to the scan Y and address A electrodes previous to the address period.

Next, the sustain period is for causing the cells to either continue to discharge to display an image on the addressed cells, or to remain inactive. Since the sustain discharge pulse, alternately having the voltages Vs and 0V, is alternately applied to the scan electrode Y and the sustain electrode X, the sustain discharge is generated in the turn-on cell selected in the address period.

FIG. 5B shows a diagram representing driving waveforms when the temperature of the PDP 100 is outside of the predetermined temperature range.

The driving waveform shown in FIG. 5B, which is used when the temperature of the PDP 100 is outside of the predetermined temperature range, is different from the driving waveform shown in FIG. 5A which is used when the temperature of the PDP 100 is within the predetermined temperature range.

As shown in FIG. 5B, when the temperature of the PDP 100 is outside of the predetermined temperature range, the appropriate amount of the positive wall charges is not yet accumulated on the respective electrodes after the reset period is finished. However, at this time, the address discharge quality gets much worse if the address voltage Va is applied by using the power recovery circuit as shown in FIG. 5A. Accordingly, when the temperature of the PDP 100 is outside of the predetermined temperature range, the subsequent address discharge may easily be generated by applying the address voltage Va by performing a hard switching operation to the address electrode A in the address period according to the first exemplary embodiment of the present invention.

As described, according to the first exemplary embodiment of the present invention, the power consumption may be reduced since the address voltage is generated by using the address power recovery circuit when the temperature of the panel is within the predetermined temperature range, and the address discharge error may be prevented since the address voltage is directly generated without using the power recovery circuit when the temperature of the panel is outside of the predetermined temperature range.

That is, in the address period, the power consumption may be reduced and the address operation may be stably performed according to the first exemplary embodiment of the present invention.

The predetermined temperature for stably performing the address discharge of the PDP 100 may be readily determined experimentally.

In addition, the power recovery circuit is generally used to apply the sustain discharge pulse to the scan Y and sustain X electrodes in the sustain period.

A sustain electrode X driving circuit in the sustain driver 300 will now be described with reference to FIG. 6.

Figure 6:
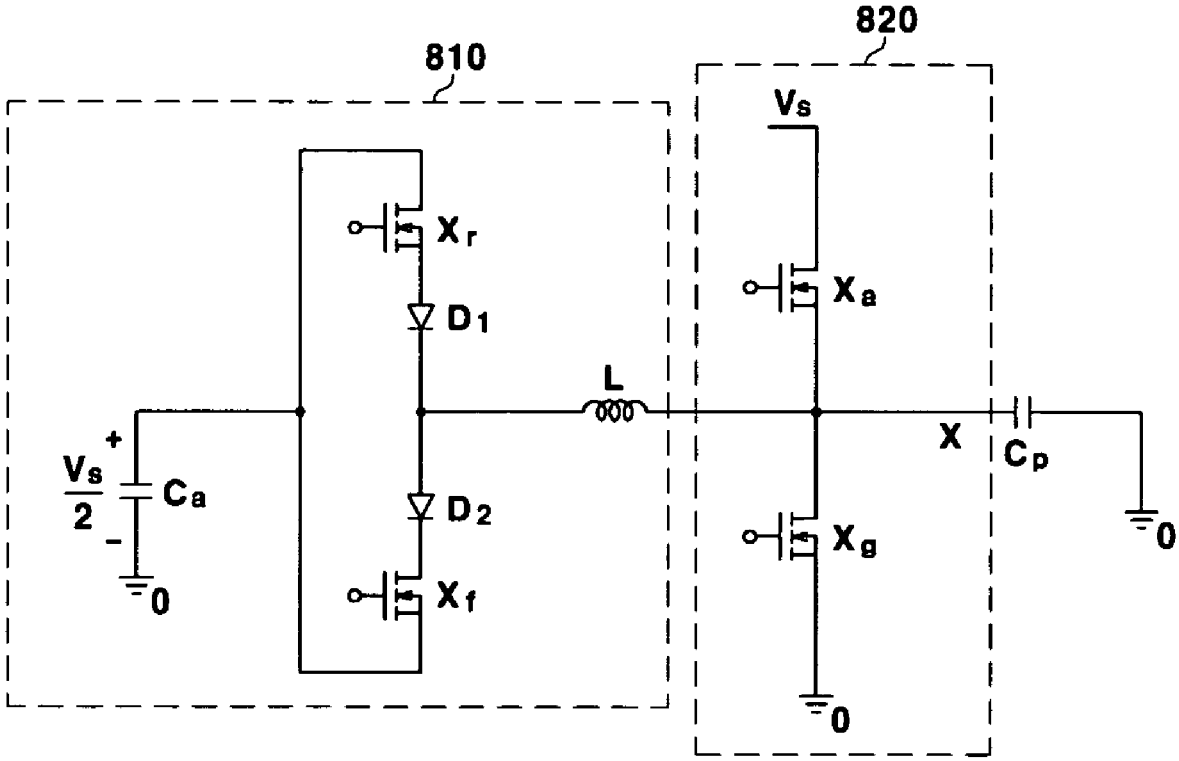
FIG. 6 shows a diagram representing a sustain driving circuit according to the exemplary embodiment of the present invention.

FIG. 6 shows a diagram representing the sustain electrode driving circuit according to the exemplary embodiment of the present invention. Configuration and characteristics of switches of the sustain electrode driving circuit are similar to those of the driving circuit of the address driver 200 shown in FIG. 4, and therefore further detailed descriptions will be omitted.

As shown in FIG. 6, the driving circuit of the sustain driver 300 according to the exemplary embodiment of the present invention includes a power recovery circuit 810 and a sustain driving unit 820.

The power recovery circuit 810 includes a capacitor Ca, switches Xr and Xf, diodes D1 and D2, and an inductor L. A voltage Vs/2 is charged at the capacitor Ca. The capacitor Ca for power recovery is electrically coupled between a drain of the switch Xr and a source of the switch Xf, and the diodes D1 and D2 are respectively coupled to the switches Xr and Xf in series. A terminal of the inductor L is electrically coupled between a node between the diodes D1 and D2 and a node between the switches Xa and Xg of the address voltage driver, and the panel capacitor Cp is coupled to another terminal of the inductor L in series. The diode D1 is for setting a path for increasing a voltage at the panel capacitor when the switch Xr has a body diode. The diode D2 is for setting a path for decreasing the voltage at the panel capacitor Cp when the switch Xf has a body diode. The diodes D1 and D2 may be eliminated when the switches Xr and Xf have no body diode. The power recovery circuit of the above configuration is for charging the voltage at the panel capacitor Cp (i.e., a voltage at the sustain electrode) to a voltage Vs, or for discharging the voltage at the panel capacitor Cp to 0V.

The sustain driving unit 820 is coupled between the power recovery circuit 810 and the panel capacitor Cp, and includes the two switches Xa and Xg. The switch Xa is coupled between a power source for supplying the sustain voltage Vs and the panel capacitor Cp, and the switch Xg is coupled between a power source for supplying a ground voltage and the panel capacitor Cp. The switches Xa and Xg respectively supply the voltage Vs and 0V to the panel capacitor Cp.

The configuration and operation of the power recovery circuit shown in FIG. 6 is similar to those of the power recovery circuit of the address driving circuit shown in FIG. 4, and therefore further description will be omitted.

In addition, while the driving circuit of the sustain driver 200 has been exemplified in FIG. 6, the power recovery circuit of the driving circuit in the sustain driver 200 has the same configuration as a power recovery circuit of the scan driver 500. Therefore, further description will be omitted.

Figure 7:
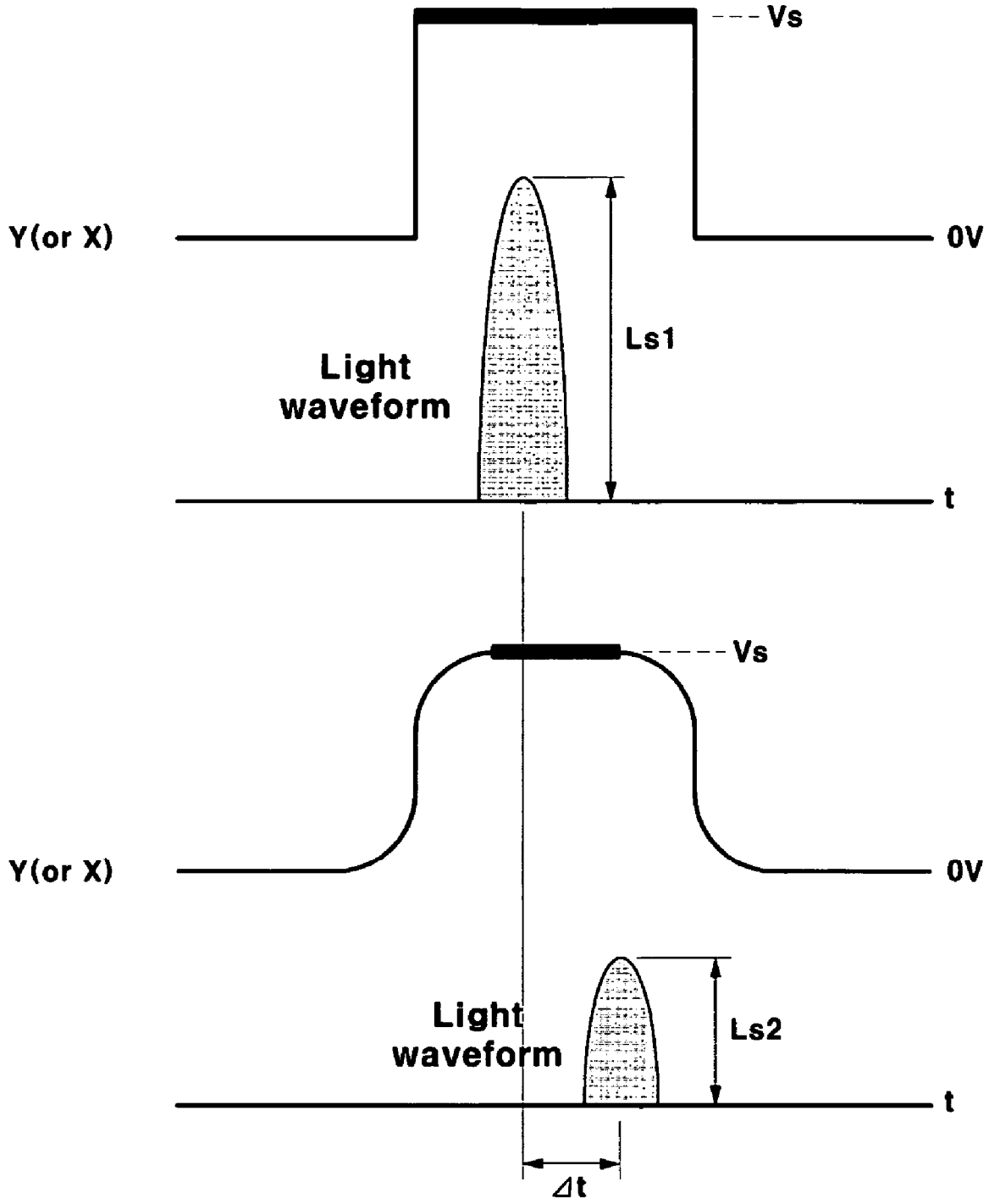
FIG. 7 shows driving waveforms applied to a scan electrode and a sustain electrode in a sustain period.

As compared to the case that the sustain discharge pulse voltage is applied without the LC resonance of the power recovery circuit as shown in FIG. 7, there is a merit of the energy recovery since the wall charge state is unstable when the temperature of the PDP 100 is outside of the predetermined temperature range. However, misfiring is highly expected since the sustain discharge is not performed stably in the sustain period because the light intensity Ls2 is less than the light intensity Ls1 (Ls<Ls1), and a time Δt for the voltage of the panel capacitor to reach the voltage Vs is delayed.

Accordingly, a method for solving the above problem according to a second exemplary embodiment of the present invention will be described with reference to the figures.

Figure 8:
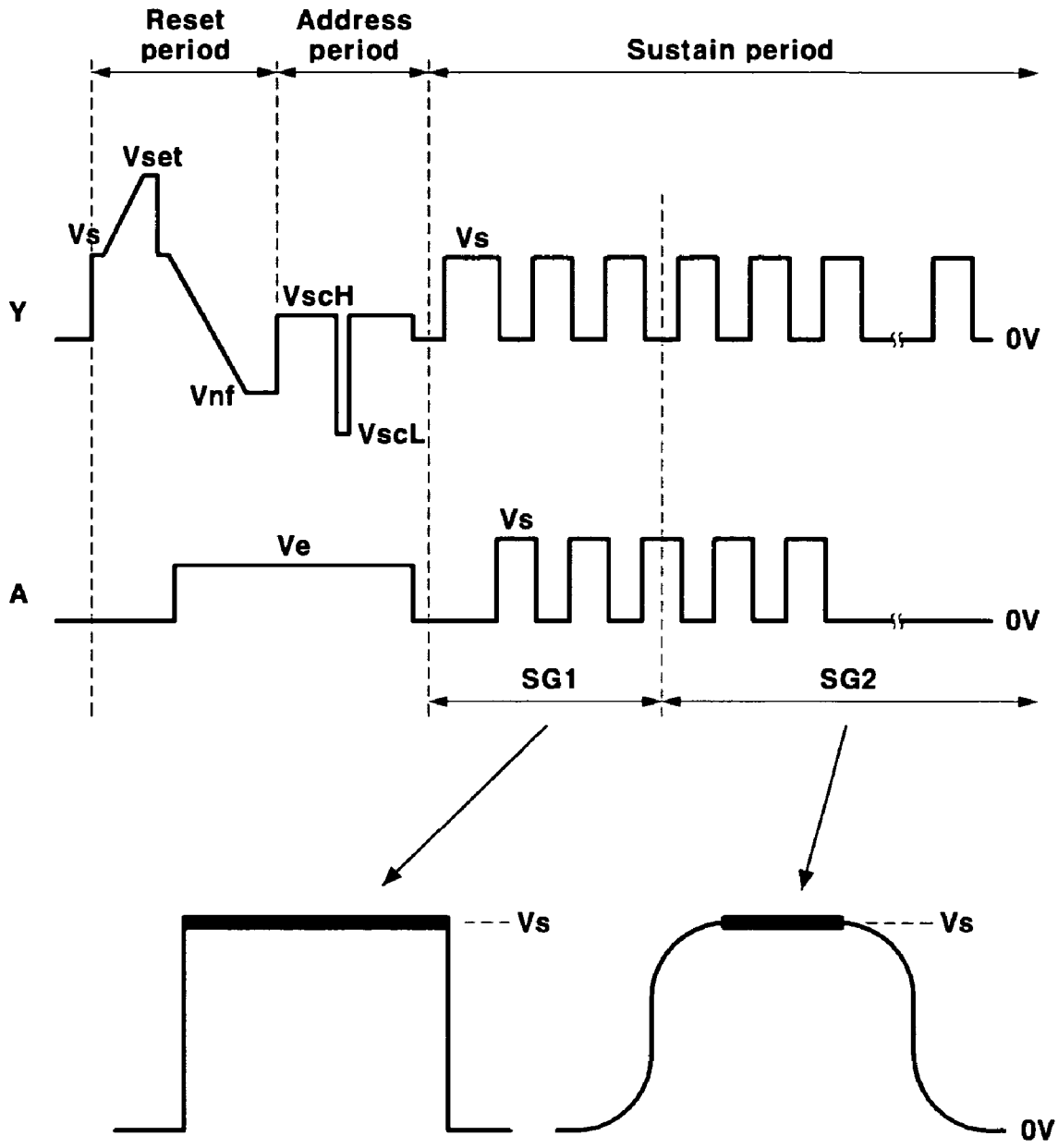
FIG. 8 shows a diagram representing driving waveforms of a plasma display device according to a second exemplary embodiment of the present invention.

FIG. 8 shows a diagram representing driving waveforms of the plasma display device according to a second exemplary embodiment of the present invention. More specifically, it shows driving waveforms formed when the temperature of the PDP 100 is outside of the predetermined temperature range (e.g., the temperature is higher than the predetermined temperature range or lower than the predetermined temperature range).

As shown in FIG. 8, the motion of wall charges formed as plasma is unstable when the temperature of the PDP 100 is outside of the predetermined temperature range. The probability of misfiring is increased since the sustain discharge quality gets much worse when the sustain discharge pulse voltage is applied by the LC resonance of the power recovery circuit in the sustain period.

Accordingly, the sustain discharge pulse is applied after dividing the sustain period into at least two groups SG1. SG2 in respective subfields when the temperature of the PDP 100 is outside of the predetermined temperature range.

That is, the sustain discharge pulse voltage is applied by the hard switching operation in a first group SG1 of the sustain period, and the sustain discharge pulse voltage by the LC resonance of the power recovery circuit is applied in a second group SG2 of the sustain period.

Hence, while the wall charge state is unstable when the temperature of the PDP 100 is outside of the predetermined temperature range, a period for stabilizing the sustain discharge is provided by applying the sustain discharge pulse voltage Vs by the hard switching operation with the high light intensity in a part of the sustain period. After stabilizing the sustain discharge, the power recovery may be performed by applying the sustain discharge pulse voltage Vs by the LC resonance of the power recovery circuit.

Accordingly, misfiring may be prevented in the sustain period of the subfields when the temperature of the PDP 100 is outside of the predetermined temperature range.

While the method for preventing misfiring caused when the temperature of the PDP 100 is outside of the predetermined temperature range has been separately described in the address period and the sustain period according to the first and second exemplary embodiments of the present invention, the method may be concurrently applied to the address and the sustain period according to another exemplary embodiment of the present invention.

As described above, according to the exemplary embodiments of the present invention, misfiring may be prevented in the address and sustain periods by performing the hard switching operation with the high light intensity instead of using the power recovery circuit in a part of the address or sustain period when the temperature of the PDP is outside of the predetermined temperature range, specifically when the temperature of the PDP is substantially higher or lower than the predetermined temperature range.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving method of a plasma display device having a power recovery circuit for applying an address voltage to third electrodes by using resonance between an inductor electrically coupled to the third electrodes and a capacitive load formed by first electrodes and second electrodes and the third electrodes in a direction crossing the first and second electrodes, the driving method comprising:

sensing a temperature of a plasma display panel;

determining whether to perform an address power recovery in an address period based on a sensed temperature;

applying a reset waveform to the first electrodes; and after applying the reset waveform to the first electrodes, applying an address voltage to associated third electrodes after generating the address voltage based on a determined result whether to perform the address power recovery in the address period.

2. The driving method of claim 1, wherein, when the temperature of the plasma display panel is outside of a temperature range when determining whether to perform the address power recovery, the address voltage is applied to the third electrodes by an inductor-capacitor resonance of the power recovery circuit.

3. The driving method of claim 1, wherein, when the temperature of the plasma display panel is within a temperature range when determining whether to perform the address power recovery, the address voltage is applied to the third electrodes without an inductor-capacitor resonance of the power recovery circuit.

4. A driving method of a plasma display device having a power recovery circuit for applying a sustain pulse voltage to first electrodes and second electrodes by using resonance between an inductor electrically coupled to third electrodes and a capacitive load formed by the first electrodes and the second electrodes and the third electrodes in a direction crossing the first electrodes and the second electrodes, the driving method comprising:

sensing a temperature of a plasma display panel;

determining whether to perform an address power recovery in an address period based on a sensed temperature;

applying a reset waveform to the first electrodes;

performing an address operation by applying a second voltage to the third electrodes when performing a scan operation by applying a first voltage to the first electrodes for selecting a discharge cell to be displayed among discharge cells, after applying the reset waveform to the first electrodes; and after performing the address operation, alternately applying a sustain discharge pulse voltage to the first electrodes and the second electrodes after generating the sustain discharge pulse voltage based on a determined result whether to perform the address power recovery in the address period.

5. The driving method of claim 4, wherein, when the temperature of the plasma display panel is outside of a temperature range in the determining of whether to perform the address power recovery:

alternately applying to the first electrodes and the second electrodes in a first group of a sustain period among at least two groups of the sustain period the sustain discharge pulse voltage without inductor-capacitor resonance of the power recovery circuit, and alternately applying to the first electrodes and the second electrodes in a second group subsequent to the first group of the sustain period the sustain discharge pulse voltage by inductor-capacitor resonance of the power recovery circuit.

6. A plasma display device including a power recovery circuit for applying an address voltage to third electrodes and a sustain pulse voltage to first electrodes and second electrodes by using resonance between an inductor electrically coupled to the third electrodes and a capacitive load formed by the first electrodes and the second electrodes and third electrodes in a direction crossing the first electrodes and the second electrodes, the plasma display device comprising:

a plasma display panel including the first electrodes and the second electrodes, and the third electrodes in a direction crossing the first electrodes and the second electrodes, and a discharge cells in a crossing part of the first electrodes and the second electrodes, and the third electrodes;

a panel temperature sensor for sensing a temperature of the plasma display panel; and a driving circuit operating for a plurality of subfields divided from a frame, each subfield including sustain, reset, and address periods, wherein the driving circuit performs an address operation after initializing all the discharge cells by:

applying a reset waveform to the first electrodes, applying an address voltage to the third electrodes for selecting a discharge cell to be displayed among the discharge cells, alternately applying a sustain discharge pulse voltage to the first electrodes and the second electrodes for generating a sustain discharge in the selected discharge cell, and determining whether to perform a power recovery operation in address periods and in sustain periods according to the temperature of the plasma display panel.

7. The plasma display device of claim 6, wherein the address voltage without inductor-capacitor resonance of the power recovery circuit is applied to the third electrodes for selecting the discharge cell to be displayed among the discharge cells in an address period when the temperature of the plasma display panel is outside of a temperature range.

8. The plasma display device of claim 6, wherein, when the temperature of the plasma display panel is outside of a temperature range:

the sustain discharge pulse voltage without the inductor-capacitor resonance of the power recovery circuit is applied to the first electrodes and the second electrodes in a first group of the sustain periods, the sustain periods being divided into at least two groups; and the sustain discharge pulse voltage by the inductor-capacitor resonance of the power recovery circuit is applied to the first electrodes and the second electrodes in a second group subsequent to the first group of the sustain periods.

* * * * *